United States Patent [19]

Norris

[11] 3,994,250

[45] Nov. 30, 1976

[54] TRANSFER PRINTING OF TEXTILE YARN

[75] Inventor: Alan H. Norris, Rome, Ga.

[73] Assignee: Champion International Corporation, Stamford, Conn.

[22] Filed: Dec. 1, 1975

[21] Appl. No.: 636,489

Related U.S. Application Data

[63] Continuation of Ser. No. 455,341, March 27, 1974, abandoned.

[52] U.S. Cl. ..... 112/266; 8/2.5 R; 101/172; 101/470; 112/410

[51] Int. Cl.[2] ..... D05B 67/00; D06P 7/00

[58] Field of Search ..... 8/2.5, 151.2; 101/172, 101/470; 112/266

[56] References Cited

UNITED STATES PATENTS

| | | | |
|---|---|---|---|
| 41,776 | 3/1864 | Hudson | 8/2.5 |
| 627,329 | 6/1899 | Dratz | 101/172 |
| 736,635 | 8/1903 | Rumpf | 101/172 |
| 747,306 | 12/1903 | Keefer | 101/172 |
| 1,982,820 | 12/1934 | Lowenstein | 8/2.5 |
| 3,632,291 | 1/1972 | Defago et al. | 101/470 |

FOREIGN PATENTS OR APPLICATIONS

| | | | |
|---|---|---|---|
| 1,189,026 | 4/1970 | United Kingdom | 8/2.5 |

OTHER PUBLICATIONS

International Dyer & Textile Printer, Mar. 19, 1971, pp. 335–340, Transfer Printing–Art or Science, by Burtonshaw.

*Primary Examiner*—Clyde I. Coughenour
*Attorney, Agent, or Firm*—Roylance, Abrams, Berdo & Kaul

[57] ABSTRACT

Textile strands are maintained in a spaced, substantially parallel relationship to each other and are brought into contact with a continuous length of a transfer web comprising a substrate having a coating of a dye capable of subliming and transferring to the textile strands and providing the textile strands with a regularly recurring pattern. The textile strands are maintained in substantial transverse registration with one another and are formed into a textile article bearing the recurring pattern in a reduced form.

5 Claims, 7 Drawing Figures

TRANSFER PRINTING OF TEXTILE YARN

This is a continuation of application Ser. No. 455,341, filed Mar. 27, 1974 now abandoned.

This invention relates to a process for providing a regularly recurring pattern on a plurality of synthetic textile strands employing a print transfer process, and to the formation of said strands into a textile article possessing said pattern in reduced form. More particularly, this invention relates to a process for providing a plurality of yarns with a regularly recurring pattern by means of a print transfer process, and to the formation of said yarns into a tufted or woven article bearing said pattern in a foreshortened, longitudinal dimension.

The production of colored patterns in carpets by printing yarn sheets and maintaining register of the yarns through fixation, washing, drying, beaming and carpet manufacturing steps has been proposed. In such process yarn from a creel is drawn by yarn feed rolls which present the yarn in a warp sheet to the printing machine, which has, for example, six color-printing heads. Coming out of the printer, the yarn goes directly into a steamer for dye fixation. After steaming, the yarn is passed through a wash-all section and a vacuum extraction unit. Next, the yarn is passed through a hot air drying unit, a dancing roll accumulater and is then wound directly onto beams. From the time that the yarn is printed until the yarn is finally formed into carpet the yarn is maintained in the same alignment, so that the pattern that is printed on the yarns is provided, intact, in the carpet.

A process has now been discovered for providing printed yarn strands, and incorporating said yarns into a textile article, such as woven or tufted goods, which process eliminates the need for multiple dyeing steps and the expensive equipment involved therewith. Surprisingly, it has been discovered that figured textile articles, such as carpet, can be formed economically and in a relatively simple manner by a process which comprises providing a plurality of unattached, synthetic textile strands in a spaced, substantially parallel relationship and a continuous length of a transfer web comprising a substrate having a coating on one surface thereof, said coating comprising a dye capable of subliming and transferring to the textile strands. The dye is disposed in the coating in a regularly recurring, predetermined, multicolored pattern. The textile strands and the coated substrate are passed through a transfer zone with the dye-containing coating in contact with the textile strands under conditions at which the dye sublimes and transfers to the textile strands thereby providing a regularly recurring pattern along the length of the textile strands. The textile strands are separated from the dye-containing coating. The separated textile strands are maintained in substantial transverse registration and are passed to an article forming zone wherein the textile strands are formed into a textile article bearing the transferred recurring pattern in a foreshortened, longitudinal dimension.

The process of the present invention thus eliminates the need for fixation, washing, drying and other operations previously required in connection with the dyeing of yarns in the previously proposed processes. Likewise, an attendant reduction in the economics of such systems is achieved by the relative simplicity of the process of the present invention.

According to a preferred embodiment of the present invention, a plurality of unattached yarn strands are provided in a spaced, substantially parallel relationship and are contacted with a continuous length of paper having a sublimable dye coating thereon, said coating being provided in the form of a regularly recurring, multicolor, pattern. The yarns and the paper transfer web are passed through a transfer zone comprising a heated roll wherein the dye sublimes and is transferred to the yarns in a recurring multicolor pattern. The yarns are beamed, and the beams are employed to feed a section of the width of a tufting machine or loom. Since the yarns are foreshortened in the tufting or weaving process, the pattern in the yarns thereby appears in foreshortened form in the final textile article.

Further objects and advantages of the invention will appear from a description of the drawings as follows, wherein.

Figure 1:
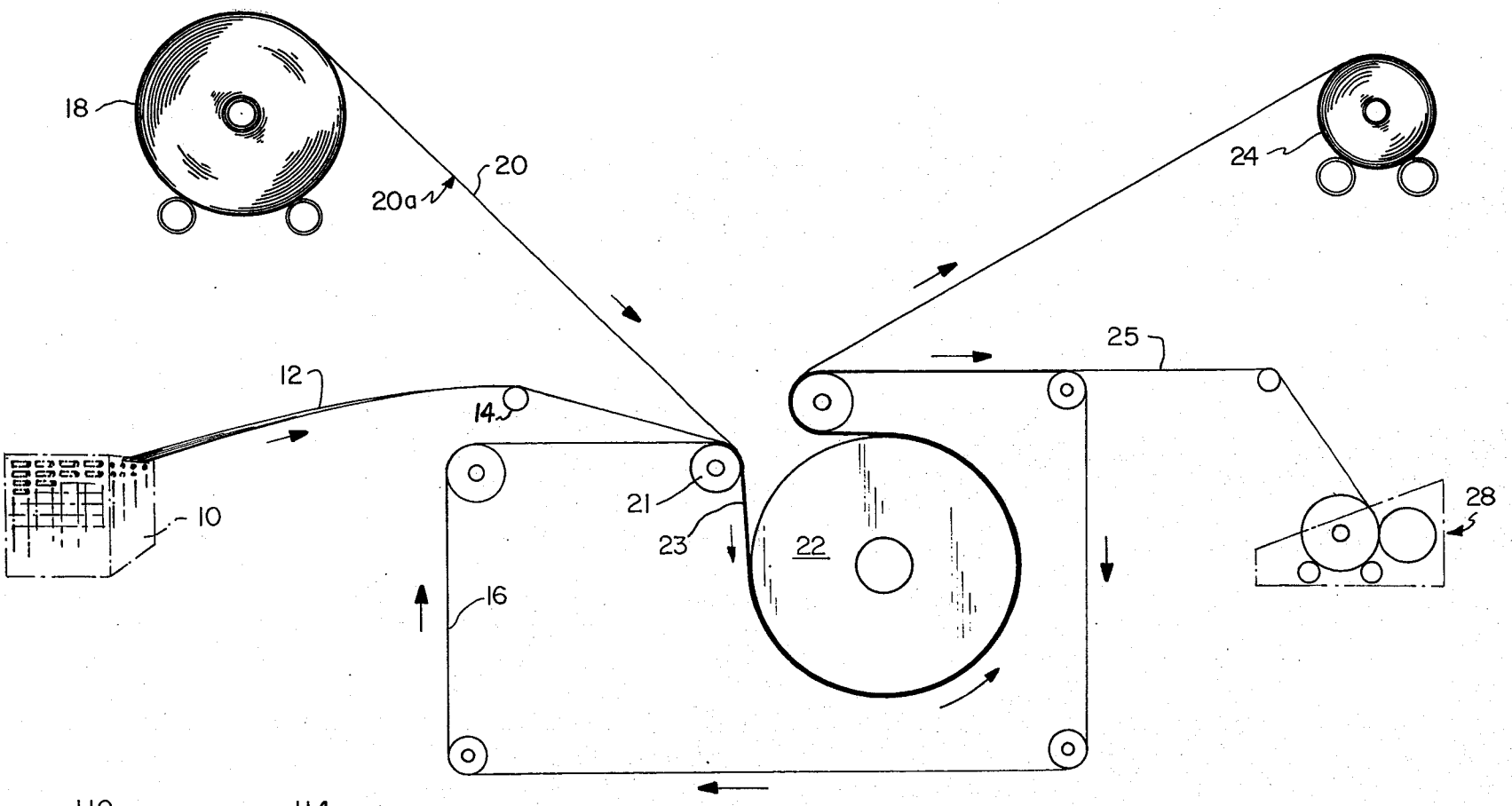
FIG. 1 is a side elevational view of a dyeing apparatus useful in the present invention.

Referring now to FIG. 1, yarn creel 10 supplies a plurality of yarns or textile strands 12, each formed from a synthetic material, such as nylon, polyester or acrylic polymer. Creel 10 may include conventional attachments for tying in new strands so that the strands of yarn are fed in a never ending supply. The strands are passed in sheet form to a feed roller 14 wherein the individual yarn strands are deposited onto the endless resilient blanket 16 in an unattached configuration. The term "unattached" is employed to indicate that the strands of yarn or other textile material are not attached as by weaving, adhesive, or the like. Roll 18 is provided with a large supply of a transfer web, such as paper, that is coated with a sublimable dye capable of transferring to the yarn strands by application of heat. The transfer web may be formed of any suitable material, including, aluminum foil, papér, cellophane or the like. Paper is preferred mainly for economic reasons.

The dyestuffs that are employed are those which have the property of sublimation, i.e., going from a solid directly to a vapor or a gas, at temperatures below the melting point of the polymeric fibers composing the yarn strands. Suitable dyes include conventional disperse dyes suitable for transfer printing, which dyes are well known to the art, and include the anthraquinoid dyestuffs, such as hydroxyanthraquinones and/or aminoanthraquinones, azo dyestuffs, quinophthalone dyestuffs, styryl dyestuffs or nitrodiarylamines, or the like. Such dyestuffs have the common feature of an absence of water solubilizing groups, however, such dyes are for the most part thermosoluble in synthetic polymers. Such dyestuffs are suitable for dyeing synthetic yarns formed of nylon, polyesters, acrylics. polypropylene and acetates. Suitable dyestuffs for such purpose are disclosed in U.S. Pat. No. 3,707,346, which is hereby incorporated by reference.

The sublimable dyes may be provided on the surface 20*a* of a paper substrate 20 in a regularly recurring, multicolored pattern. The provision of such pattern onto the paper comprising roll 18 may be accomplished utilizing any suitable printing technique including rotary gravure, flexographic printing or the like. The production of paper having a sublimable dyestuff thereon in a printed pattern is well known in the art.

The dye coated transfer paper 20 and the resilient blanket 16 carrying the yarn strands are passed by means of roller 21 to a transfer zone for transfer of the sublimable dyes to the yarn strands. As shown in FIG. 1 the transfer zone comprises a heating surface provided by a large, heated, rotating drum 22. The tensioned, continuous blanket 16 is guided around the drum by various let-off support and takeup rolls (not shown). The sandwich 23 comprising the blanket 16, yarn strands 12 and the paper 20 is passed around the heated drum 22 under conditions which cause the dye to sublime and transfer to the yarn strands.

Any suitable transfer conditions may be employed. However, for example, temperatures in the range of between about 200° and about 240° C., and contact times of between about 10 and about 60 seconds may be employed for transferring the recurring patterned dyes to the yarn strands. The particular conditions employed will depend upon the particular dyestuffs utilized and the nature of the yarn that is being dyed. However, as previously mentioned, the particular conditions to be employed in the transfer zone may be easily determined experimentally by conventional methods.

Next, the yarn strands 12 and the paper 18 are withdrawn from the transfer zone and delaminated. The paper is collected on roll 24, while the yarns 25 carrying a pattern are beamed on beamer 28. Each sheet of yarns filling a beam has the same pattern transfer printed on it in a lengthwise repeating pattern.

Figure 2:
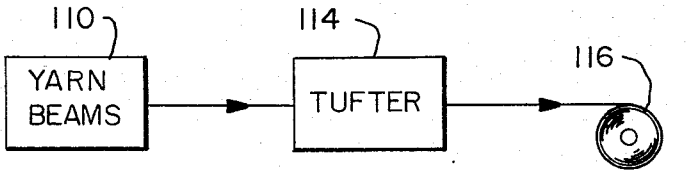
FIG. 2 is a schematic illustrating the formation of tufted carpet from the printed yarn of FIG. 1.

Referring now to FIG. 2 yarn beams 110 are those that were formed from the yarn collected by means of beamer 28 in FIG. 1. A plurality of yarn beams 110 simultaneously supply yarn 112 in synchronization to tufting machine 114 which incorporates the yarn into a tufted product 116, such as a 15-foot wide carpet. Tufting machine 114 is similar in construction and operation to conventional tufting machines. However, machine 114 utilizes apparatus to control the rate of feed of yarns to the machine. The techniques and equipment for maintaining the transverse registration of the yarn strands from the printing transfer zone. until the strands are tufted into a product are well known and include those means described in U.S. Pat. Nos. 3,550,543 and 3,561,235 which are hereby incorporated by reference. One means of assuring the proper synchronization of the transfer printed yarns is by printing an index yarn and placing such index yarn on each of the beams that are being run. The index yarn may be a white yarn which is printed with an index spot at regular intervals corresponding to the repeat length, or a fraction of the repeat length of the pattern. In tufting, an ordinary level pile machine is used, either cut pile or loop pile, and it is fitted with an attachment to keep the beams synchronized by means of the index yarn. The index yarns from each beam are scanned photo-electrically and if they do not all present the index spot to the scanning section at the same time, compensation speed sections take place to correct any misalignment. Such equipment is well known to the art and is described, for example, in U.S. Pat. 3,550,543. In the case of slow running looms, the photo-electric equipment may be omitted, since the inspection can then be manual.

Figure 3A:
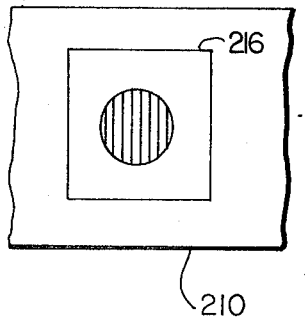
FIGS. 3A, 3B and 3C illustrate the transformation of a pattern from the transfer sheet to the yarns and then to the carpet.
Figure 3B:
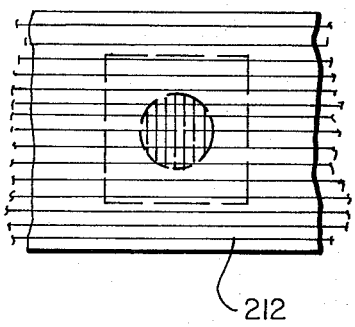
Figure 3C:
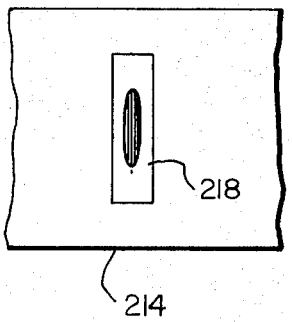
Figure 3D:
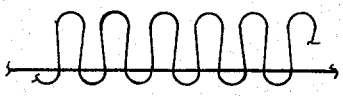
FIG. 3D illustrates the foreshortening of a yarn strand.

Referring now to FIGS. 3A, 3B and 3C the transformation of a multicolor pattern from a paper transfer web in FIG. 3A to yarn strands 212 in FIG. 3B and finally to carpet 214 in FIG. 3C is illustrated. As seen in FIG. 3B, the pattern 216 appears on the yarn strands 212 in substantially identical dimension as is present in the paper transfer web in FIG. 3A, but in a foreshortened form 218 in the carpet 214 of FIG. 3C. The reason for this is, of course, that the yarn strands 212 are foreshortened as shown in FIG. 3D upon being tufted into the carpet 214.

Figure 4:
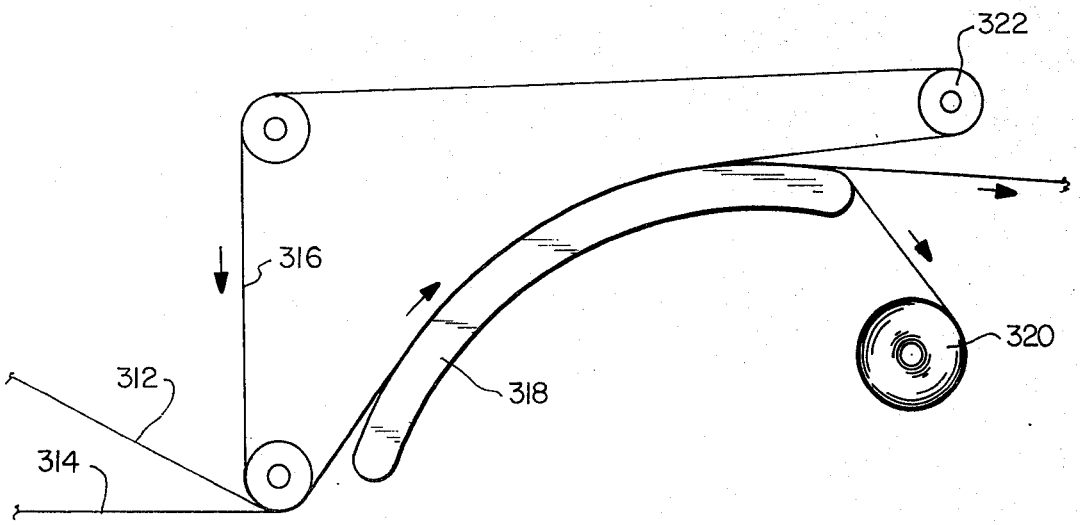
FIG. 4 is a side elevational view of a preferred transfer zone.

Referring now to FIG. 4, a preferred form of heating zone is illustrated. In this embodiment of the invention, the yarns 312 are deposited onto the paper 314, that is printed with sublimable dyes, rather than onto a resilient blanket, as illustrated in FIG. 1. Next the yarn strands 312 are sandwiched between the paper 314 and endless aluminum sheet 316. The sandwich 314 is passed over a heated steel platen 318 thus causing the dyes to transfer to the yarn strands. The yarns receive less pressure employing this embodiment of the invention with less inhibiting of yarn bulking as compared with the heated roller embodiment of FIG. 1. Next, the used paper 319 is separated from the yarn 312 and aluminum sheet 316, and is collected on takeup roll 320 while the aluminum is recycled by means of aluminum pickup roll 322. The yarn 312 is then collected on a beamer in a manner similar to that shown in regard to beamer 28 in FIG. 1.

EXAMPLE

Approximately 144 nylon yarn strands (2600 denier, two-ply, 15 denier per filament) are fed in parallel under a tension of about 5–20 grams per end to a heat transfer zone formed of a heated roll, such as illustrated in FIG. 1. Prior to entry into the transfer zone, the yarns, which are supported on an endless blanket, are brought into contact with a disperse dye-coated transfer paper having a longitudinally recurring, multicolored pattern printed thereon formed from anthraquinoid dyestuffs, such as 1,8-dihydroxy-4,5-diamino-anthraquinone. The temperature of the heated roller is about 220° C. and the roll is designed to provide 40 seconds of contact with a given area of yarns.

Under such conditions, the recurring pattern is transferred to the yarns which are maintained in transverse registration as they are beamed. The process is continued until ten yarn beams are filled, and then the beams are simultaneously utilized to feed a tufting machine while photo-electrically maintaining the yarns in transverse registration employing an index yarn. The ten synchronized yarn beams are employed to tuft a fifteen foot wide carpet backing and therein provide the resulting tufted carpet with the transfer printed recurring patterns, in reduced longitudinal dimension.

This invention has been described in considerable detail with particular reference to preferred embodiment but it will be understood that variations and modifications can be effected within the spirit and scope of the invention as described in the appended claims.

What is claimed is:

1. A process for forming figured carpet which comprises:

passing a plurality of unattached, synthetic textile yarn strands in a closely spaced, substantially parallel relationship to a transfer zone;

simultaneously passing to the transfer zone a continuous length of a paper web having a coating on one surface thereof, said coating comprising different colored dyes capable of subliming and transferring to said yarn strands upon application of heat, said dye being disposed in said coating in a regularly recurring, lengthwise, multicolored pattern having dimensions in the direction of yarn strand movement significantly longer than the desired dimensions of the pattern in the final figured carpet;

continuously passing said yarn strands in said parallel relationship and said coated paper through the transfer zone with said dye-containing coating in contact with said yarn strands;

heating the transfer zone to establish conditions under which said dye sublimes and transfers to said yarn strands to transfer said dye to said yarn strands in a regularly recurring pattern along the length of said yarn strands;

separating said yarn strands from said dye-containing coating while maintaining said separated yarn strands in said parallel relationship and in substantial transverse registration; and passing said parallel yarn strands in registration to a tufter and tufting said yarns into a carpet backing to form a tufted carpet bearing said transferred recurring pattern in a foreshortened form.

2. The process of claim 1 wherein said yarn strands are separated from said dye-containing coating and beamed prior to being passed to said article-forming zone.

3. The process of claim 1 wherein said yarn strands are subjected to a temperature in the range of between about 200° and about 240° C. during passage through said transfer zone.

4. The process of claim 1 wherein said yarn strands are formed from a synthetic polymer.

5. The process of claim 4 wherein the yarn is nylon, polyester or acrylic polymer.

* * * * *